US006364054B1

(12) United States Patent
Bubulka et al.

(10) Patent No.: US 6,364,054 B1
(45) Date of Patent: Apr. 2, 2002

(54) HIGH PERFORMANCE MUFFLER

(75) Inventors: John Bubulka, Westchester, IL (US); Charles Beaman, North Fond du Lac; Michael Grover, Hartford, both of WI (US); Ryan Traxinger, Palatine, IL (US)

(73) Assignee: Midas International Corporation, Itasca, IL (US)

( * ) Notice: Subject to any disclaimer, the term of this patent is extended or adjusted under 35 U.S.C. 154(b) by 0 days.

(21) Appl. No.: 09/492,716

(22) Filed: Jan. 27, 2000

(51) Int. Cl.[7] ..... F01N 1/08
(52) U.S. Cl. ..... 181/264; 181/282
(58) Field of Search ..... 181/249, 255, 181/264, 269, 272, 273, 276, 279, 280, 281, 282

(56) References Cited

U.S. PATENT DOCUMENTS

| | | | |
|---|---|---|---|
| 624,062 | A | 5/1899 | Mattews et al. |
| 1,002,801 | A | 9/1911 | Boeck |
| 1,081,348 | A | 12/1913 | Unke |
| 1,085,203 | A | 1/1914 | Gipple |
| 1,182,611 | A | 5/1916 | Weaver |

(List continued on next page.)

*Primary Examiner*—Marlon T. Fletcher
*Assistant Examiner*—Edgardo San Martin
(74) *Attorney, Agent, or Firm*—Anthony S. Zummer

(57) ABSTRACT

A high performance muffler is used to modify sound waves of exhaust gases generated by a high performance internal combustion engine. The muffler has an inlet for connection to an internal combustion engine exhaust system. A muffler body is connected to the inlet. The muffler body has a shell which has a width greater than its height. The shell includes a pair of spaced apart opposed panels. An outlet is connected to the muffler body to receive exhaust gases from the body. The muffler body has a first expansion chamber adjacent to the inlet. The first expansion chamber extends across the width of the muffler body. A first reduced opening is in the muffler body extending across the width of the muffler body. A second expansion chamber is in the muffler body adjacent to the first reduced opening. The second expansion chamber also extends across the width of the muffler body. A second reduced opening extending across the width of the muffler body communicates with the second expansion chamber. The second reduced opening and first reduced opening cooperate to direct flow of the exhaust gases through the muffler body in a sinuous path. A third expansion chamber extends across the width of the muffler body and is positioned adjacent to the second reduced opening. The third expansion chamber communicates with the outlet so that gases flowing in the sinuous path are exhausted from the muffler body.

17 Claims, 2 Drawing Sheets

U.S. PATENT DOCUMENTS

| | | | | |
|---|---|---|---|---|
| 1,184,431 | A | | 5/1916 | Dodge |
| 1,677,570 | A | | 7/1928 | Stade |
| 1,756,916 | A | | 4/1930 | Stranahan |
| 1,804,070 | A | | 5/1931 | Sykes |
| 1,810,252 | A | | 6/1931 | Noonan |
| 1,946,908 | A | | 2/1934 | Hanson |
| 1,998,386 | A | | 4/1935 | Powell |
| 2,071,351 | A | | 2/1937 | McNamar |
| 2,239,549 | A | | 4/1941 | Chipley |
| 2,325,905 | A | | 8/1943 | Caulfield |
| 2,392,247 | A | | 1/1946 | Katcher |
| 2,484,826 | A | | 10/1949 | Harley |
| 2,484,827 | A | | 10/1949 | Harley |
| 2,485,555 | A | | 10/1949 | Bester |
| 2,667,940 | A | | 2/1954 | Gallihugh |
| 2,707,525 | A | | 5/1955 | Janeway |
| 2,727,584 | A | * | 12/1955 | Marx ..... 181/280 |
| 2,896,743 | A | | 7/1959 | Bradshaw |
| 2,934,889 | A | | 5/1960 | Poulos |
| 2,971,599 | A | | 2/1961 | Tobias |
| 3,016,972 | A | | 1/1962 | Dugas |
| 3,029,895 | A | | 4/1962 | Lyon |
| 3,029,896 | A | | 4/1962 | Lyon |
| 3,092,206 | A | | 6/1963 | Moreau |
| 3,111,191 | A | | 11/1963 | Bachert |
| 3,113,635 | A | | 12/1963 | Allen et al. |
| 3,219,141 | A | | 11/1965 | Willimaitis |
| 3,220,508 | A | | 11/1965 | Nordquest et al. |
| 3,292,731 | A | | 12/1966 | Ballard |
| 3,666,044 | A | | 5/1972 | Killian |
| 3,786,898 | A | | 1/1974 | Foster et al. |
| 3,966,015 | A | | 6/1976 | Bychinsky |
| 4,093,040 | A | | 6/1978 | Treiber |
| 4,143,739 | A | | 3/1979 | Nordlie |
| 4,154,265 | A | | 5/1979 | Holsomback |
| 4,243,117 | A | | 1/1981 | Warnaka |
| 4,287,962 | A | | 9/1981 | Ingard et al. |
| 4,346,783 | A | | 8/1982 | Scarton et al. |
| 4,574,914 | A | | 3/1986 | Flugger |
| 4,809,812 | A | | 3/1989 | Flugger |
| 4,854,416 | A | | 8/1989 | Lalikos et al. |
| 5,200,582 | A | | 4/1993 | Kraai, Jr. et al. |
| 5,304,749 | A | | 4/1994 | Crandell |
| 5,444,197 | A | | 8/1995 | Flugger |
| 5,703,338 | A | | 12/1997 | Liese |
| 5,739,484 | A | | 4/1998 | Jones |
| 5,773,770 | A | | 6/1998 | Jones |
| 5,824,972 | A | * | 10/1998 | Butler ..... 181/280 |
| 5,930,371 | A | | 7/1999 | Cheng et al. |
| 5,936,210 | A | | 8/1999 | Borneby et al. |

* cited by examiner

HIGH PERFORMANCE MUFFLER

BACKGROUND OF THE INVENTION

A class of automobiles which have a high power-to-weight ration are often referred to as high performance cars. Some of the automobiles in this class are often referred to as street racers. It is desirable that the power from an internal combustion engine in these automobiles be maximized. Inasmuch as it is necessary that these automobiles have a muffler, the muffler must be one which attenuates the sound from the exhaust gases but creates the least back pressure, so that there is a minimization of loss of power due to the muffler. Mufflers of this general type are typically referred to as "high performance mufflers." In addition to attenuating the sound of the exhaust gases with a minimum of back pressure, the sound of exhaust gases leaving the muffler must not only have an acceptable volume, but also have a deep throaty high performance sound. The deep throaty high performance sound is a particular desirable feature for many persons associated with high performance cars. All of the desired features must be included in a small or compact muffler which is sturdy and economical to manufacture.

BRIEF SUMMARY OF THE INVENTION

The present invention is directed to a high performance muffler for modifying sound waves of internal combustion engine exhaust gases. The muffler includes an inlet adapted for connection to an internal combustion engine exhaust system to receive the exhaust gases from an internal combustion engine. A muffler body is connected to the inlet for receiving the exhaust gases. The muffler body includes a shell which has a width greater than its height. The shell has a pair of spaced apart opposed panels. An outlet is connected to the muffler body to receive exhaust gases from the body which flow through the body in a defined flow path. The muffler body has a first expansion chamber adjacent to the inlet to receive exhaust gases from the inlet to allow the exhaust gases to expand. The first expansion chamber extends across the width of the muffler body. A first reduced opening is defined in the muffler body communicating with the first expansion chamber to receive exhaust gases from the first expansion chamber. The first reduced opening also extends across the width of the muffler body. A second expansion chamber in the muffler body is adjacent to the first reduced opening and receives exhaust gases from the first reduced opening. The second expansion chamber also extends across the width of the muffler body. The muffler body has a second reduced opening extending across the width of the muffler body and communicates with the second expansion chamber to receive exhaust gases from the second expansion chamber. The second reduced opening and the first reduced opening cooperate to direct the flow of exhaust gases through the muffler body in a sinuous flow path. A third expansion chamber which extends across the width of the muffler body is positioned adjacent to the second reduced opening and receives exhaust gases from the second reduced opening. The third expansion chamber communicates with the outlet to allow exhaust gases to leave the muffler body. The volume of the sound of the exhaust gases passing through the muffler body is decreased by conversion of a part of the sound energy to heat energy and the frequency of the sound of the exhaust gases is modified in the muffler body.

DETAILED DESCRIPTION OF THE INVENTION

Figure 2:
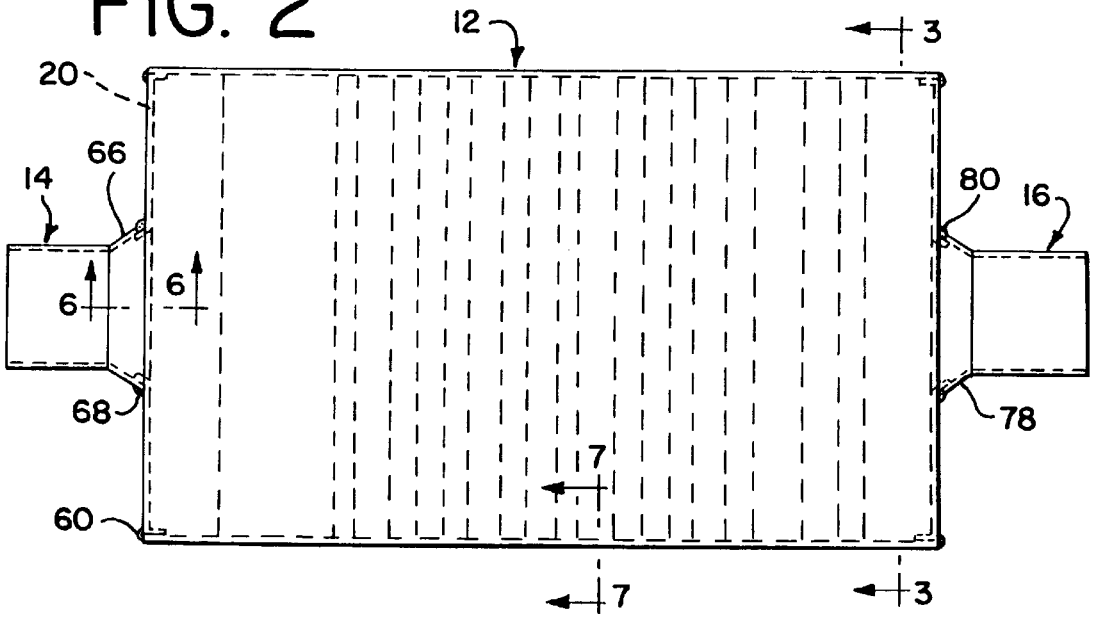
FIG. 2 is a plan view of the muffler of FIG. 1.

Referring now the drawings, a high performance muffler, which is a specific embodiment of the instant invention, is shown therein and is generally identified by numeral 10. The high performance muffler is made of sixteen gauge aluminized steel in this instance though other materials may be used. Muffler 10 generally includes a muffler body 12 with an inlet formed by an inlet nipple 14 connected to one end of the body. An outlet formed by an outlet nipple 16 is connected to the other end of the body, as may be seen in FIG. 2. The inlet nipple is connected to a conventional exhaust system of a conventional high performance automobile, having a well known internal combustion engine, none of which is shown herein inasmuch as the construction of these devices is well known in the art. Exhaust gases created by the internal combustion engine as is well known in the art are delivered to the exhaust system and then to the muffler.

Muffler body 12 includes a shell 18 with a cap plate 20 mounted in one end of the shell. The cap plate is connected to inlet nipple 14. An end plate 22 is mounted in the other end of the shell, and the end plate is connected to outlet nipple 16. The muffler body has deflectors 24, 26, 28, 30, and 32 mounted within the body. The construction of each of the deflectors is, in this instance, identical to the construction of each of the other deflectors, except that deflectors 26 and 30 are inverted as to the other deflectors in their installation within the shell.

Figure 1:
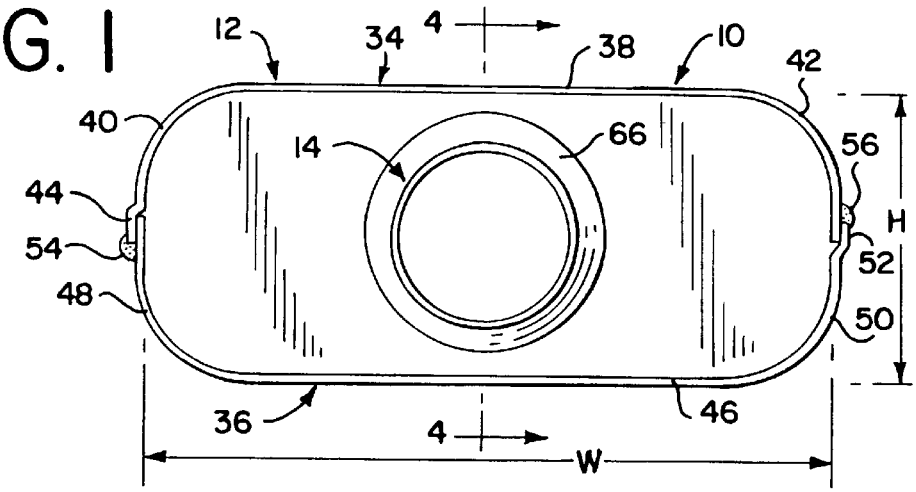
FIG. 1 is an end view of a high performance muffler embodying the herein disclosed invention.
Figure 3:
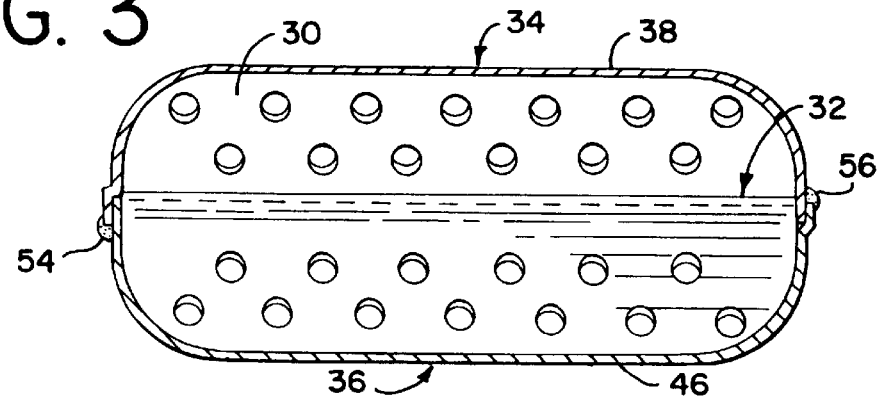
FIG. 3 is a cross sectional view taken on Line 3—3 of FIG. 2 showing a pair of deflectors.

Shell 18 is made up of two identical opposed panels 34 and 36 which mate. As may be seen in FIGS. 1 and 3, panel 34 includes a plate 38 with rounded edges 40 and 42 formed integral with opposed edges of the plate. Rounded edge 42 includes a locking lip 44. In a like manner, panel 36 includes opposed plate 46 with rounded edges 48 and 50 formed integral with opposed edges of plate 46. Rounded edge 50 includes a locking lip 52. Edge 48 of plate 46 fits in contact with lip 44 and is welded to the lip by weld bead 54 to form a seal between the lip and the edge. In a like manner, edge 42 of plate 38 fits in a mating contact to lip 52 and is sealingly connected thereto by a weld bead 56. Plates 38 and 46 are opposed to each other and are generally parallel to each other. The width (W)of the shell is two and one-half times greater than the height (H) of the shell, as viewed in FIG. 1. It is desirable for the shell to have a width (W) at least twice the height (H) of the shell, but no greater than three times the height of the shell.

Cap plate 20 fits inside one end of shell 34. Cap plate 20 has a skirt 58 on its outer periphery to engage mateably the interior of the shell. The cap plate is held within the shell by a weld bead 60 to hold sealingly the cap plate in place within the shell. The cap plate contains an inlet aperture 62 defined by a rim 64. The inlet nipple includes a flared out nozzle portion 66 which mateably receives rim 64. Nozzle 66 is welded to the cap plate by a continuous bead 68 to form a sealing connection between the nipple and the cap plate.

Figure 4:
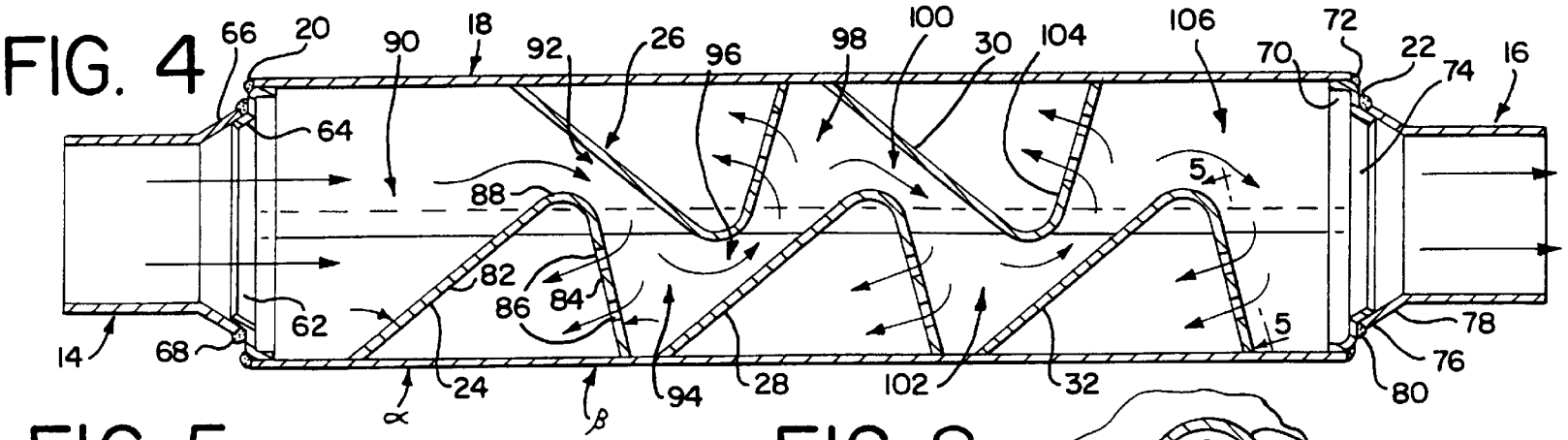
FIG. 4 is a cross sectional view taken on Line 4—4 of FIG. 1.

End plate 22 also has a skirt 70 which is mateably received within the shell, as seen in FIG. 4. The end plate is sealingly secured to the shell by a weld bead 72. The end plate contains an exit aperture 74 defined by a rim 76. The outlet nipple includes an outlet nozzle 78 which mateably receives rim 76. A weld bead 80 sealingly connects nozzle 78 to the end plate. The subject construction provides a sealed muffler body with inlet and outlet nipples 14 and 16 at opposite ends. Exhaust gases entering the body through the inlet nipple must exit through the outlet nipple, which may be connected to a conventional tail pipe, which is well known and not shown herein.

Deflector 24 includes an inlet plate 82 which is welded to the shell and form an angle $\alpha$ with panel 36. In this instance, angle a is thirty-five degrees; however, angle $\alpha$ may vary from twenty degrees to eighty degrees. Deflector 24 has an outlet plate 84 which is welded to the shell and forms an angle $\beta$ with panel 36. In this instance, angle $\beta$ is seventy degrees; however, the angle may vary from twenty degrees to eighty degrees. The outlet plate is connected to the inlet plate by a striker 88 which is rounded to reduce turbulence as exhaust gases flow over the striker. The inlet plate, outlet plate, and striker of the deflector 24 extend across the width of the shell, so that the deflector is perpendicular to the length of the shell. The distance of the top of the striker 88 to the opposed panel 34 is sixty percent of the height of the interior portion of the shell, that is, the entire distance between panels 34 and 36 at their greatest distance apart.

Deflectors 26, 28, 30, and 32 have the same construction as deflector 24, in that, each deflector includes an inlet plate and an outlet plate joined by a rounded striker. Deflectors 28 and 32 are mounted on panel 36, as is deflector 24, while deflectors 26 and 30 are mounted on the opposite panel 34. In each case, the distance from each striker to the opposite panel is sixty percent of the maximum height of the interior portion of the shell.

Figure 5:
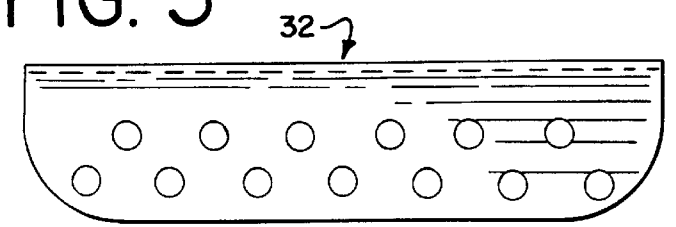
FIG. 5 is an enlarged plan view of a portion of a deflector taken on Line 5—5 of FIG. 4.

Deflector 24 has thirteen apertures 86 in its outlet plate, as does each outlet plate of each of the other deflector. The apertures are arranged in the some same manner in each outlet plate. As may be best seen in FIG. 5, the apertures are aligned in two rows. The apertures in each row are equidistant from adjacent apertures. However, the number, positions, and size of the aperture may be varied.

As may be seen in FIG. 4, inlet plate 82 of deflector 24 with the shell and cap plate defines a first inlet chamber 90. Inlet chamber 90 extends across the width of the shell. Exhaust gases entering the muffler body through aperture 62 expand in expansion chamber 90. The second deflector 26 has its inlet plate positioned adjacent to striker 88 of deflector 24 to define a first reduced opening 92, which extends the width of the shell. Exhaust gases flowing from expansion chamber 90 flow through the first reduced opening and are compressed. A second expansion chamber 94 is defined by outlet plate 84, deflector 26, deflector 28, and the shell. Thus, exhaust gases flowing from the first reduced opening 92 into the second expansion chamber are allowed to expand. A second reduced opening 96 is defined by the second deflector and the inlet plate of the third deflector. The second reduced opening extends across the width of the shell so that the exhaust gases from the second expansion chamber 94 are compressed through the second reduced opening. A third expansion chamber 98 is defined by the outlet plate of deflector 26, the inlet plate of deflector 28, the inlet plate of deflector 30, and the shell. The third expansion chamber extends across the width of the shell. Exhaust gases flowing from the second reduced opening expand in the expansion chamber. A third reduced opening 100 is defined by the third deflector 28 and the inlet plate of deflector 30. The third reduced opening extends across the width of the shell, and exhaust gases flowing through the third reduced opening are compressed. A fourth expansion chamber 102 is defined by the outlet plate of deflector 28, the inlet plate of deflector 30, the inlet plate of deflector 32, and the shell. Exhaust gases flow from the third reduced opening into the fourth expansion chamber 102 and expand in chamber 102. A fourth reduced opening 104 is defined by deflector 30 and the inlet plate of deflector 32. The fourth reduced opening extends across the width of the shell. Exhaust gases are compressed in the fourth reduced opening. A fifth and final expansion chamber 106 is defined by deflector 32, the outlet plate of deflector 30, the end plate, and the shell where the exhaust gases again expand. Fifth expansion chamber 106 communicates with aperture 74 and thus to outlet nipple 16 to allow the exhaust gases to leave the muffler body.

As may be seen in FIG. 4, the flow path through the muffler body is a sinuous flow path whereby internal combustion engine exhaust gases flow into the first expansion chamber 90 and then flow up and over deflector 24 through reduced opening 92, and are allowed to expand in second expansion chamber 94. The gases then flow down and under deflector 26 through second reduced opening 96 and into third expansion chamber 98. The exhaust gases flow up and over deflector 28 through third reduced opening 100 and into fourth expansion chamber 102. The gases then flow down and under deflector 30 through the fourth reduced opening 104 and into the fifth and final expansion chamber 106 from which the gases exit the muffler. Each of the deflectors has a plurality of apertures in the outlet plate to modify the sound of the exhaust gases. It may be appreciated that the sinuous flow path of the exhaust gases through the muffler body with the repeated expansion and compression of the exhaust gases causes the muffler body to convert the sound energy into heat energy and the frequency of the sound is further attenuated within the deflectors.

Figure 8:
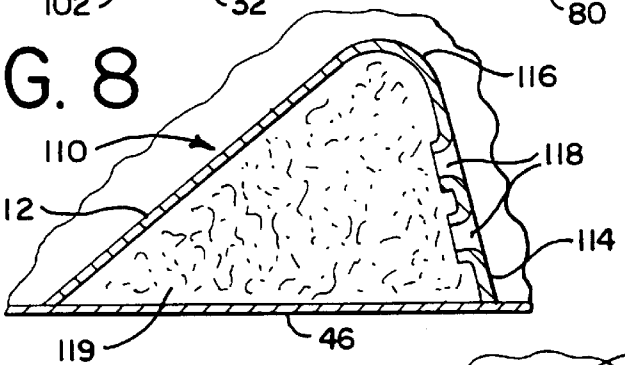
FIG. 8 is a cross sectional view taken through a modified deflector wherein apertures in the deflector are extruded apertures and the deflector is filled with a fiber glass filling.

The deflectors may be modified by having extruding apertures in the plates. A modified deflector 110 is shown in FIG. 8 mounted on opposed plate 46. Deflector 110 has the same construction as deflectors 24, 26, 28, 30, and 32, except for the form of the apertures and a filler in the interior of the deflector. Deflector 110 has an inlet plate 112 and an outlet plate 114 connected by a rounded striker 116. The outlet plate has extruded aperture 118 rather than aperture 86. In this instance, deflector 110 is filled with a fiberglass filler 119.

Figure 9:
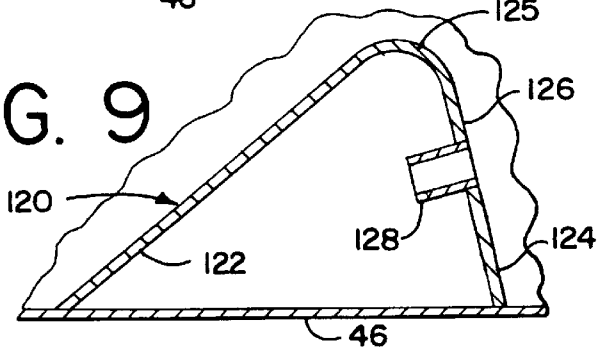
FIG. 9 is a cross sectional view taken through another modified deflector showing a Helmholtz tube mounted in a deflector.
Figure 7:
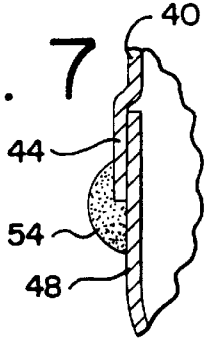
FIG. 7 is an enlarged cross sectional view taken on Line 7—7 of FIG. 2.
Figure 6:
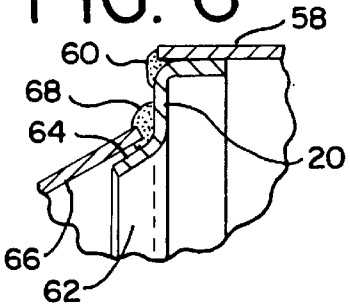
FIG. 6 is an enlarged cross sectional view taken on Line 6—6 of FIG. 2.

A further modified deflector 120 is shown in FIG. 9 mounted on opposed plate 46. Deflector 120 is identical to the other deflectors, but with the addition of a Helmholtz tube in the deflector. Deflector 120 includes an inlet plate 122 and an outlet plate 124 connected by a rounded striker 125. The outlet plate has an aperture 126 similar to apertures 86. In this instance, a conventional Helmholtz tube 128 is mounted in the aperture 126 to modify the frequency of the exhaust gases passing through the muffler body.

It is readily apparent that the subject muffler may be modified to achieve a particular frequency by modifying the deflectors to produce a particular sound desired by any given class of users. However, the basic construction remains the same. The internal combustion engine exhaust gases are delivered to a first expansion chamber and then flow through a first reduced opening and into a second expansion chamber. The exhaust gases are alternately compressed and allowed to expand during their passage through the muffler body. The sinusoidal path of the exhaust gases in cooperation with the deflector construction provides a high performance muffler which allows the gases to be attenuated to a selected volume and frequency with a minimum increase of back pressure. The subject construction provides an economical construction, in that, the muffler may be readily formed and assembled by welding to produce a muffler having a sturdy construction so that it may withstand high intensity usage.

Although a specific embodiment of the herein disclosed invention has been shown in the accompanying drawings and described in detail above, it is to be expressly understood that the instant invention is limited only by the appended claims.

What is claimed is:

1. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell's width is greater than two times the height of the shell and less than three times the height of the shell, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body.

2. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector defining a portion of the first expansion chamber, and a second deflector mounted on the other panel of said pair of opposed panels, said second deflector defining a portion of the first reduced opening, the minimum distance from each deflector to the panel opposite to the panel upon which the respective deflector is mounted being less than one half of the distance between the opposed panels.

3. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, and a first deflector mounted on one panel of said pair of opposed panels defining a portion of the first expansion chamber, said first deflector having an apertured plate for receiving exhaust gases.

4. A high performance muffler for modifying sound waves of internal combustion exhaust gases engine comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, and a first deflector mounted on one panel of said pair of opposed panels, said first deflector having a first inlet plate defining a portion of the first expansion chamber, said first deflector having a first outlet plate connected to the inlet plate defining a portion of the second expansion chamber, and a second deflector mounted on the other panel of said pair of opposed panels defining a portion of the first reduced opening, said second deflector having a second inlet plate defining a portion of the first reduced opening, and said second deflector including a second outlet plate connected to the second inlet plate, said second outlet plate defining a portion of the third expansion chamber.

5. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector having a first inlet plate defining a portion of the first expansion chamber, said first outlet plate defining a portion of a second expansion chamber, said first inlet plate forming a first inlet angle with said one panel of said pair of opposed panels being equal to or greater than 20° or being equal to or less than 80°, said first deflector having a first outlet plate connected to the first inlet plate, said first outlet plate forming a first outlet angle with said one panel of said pair of opposed panels being equal to or greater than 20° or being equal to or less than 80°, a second deflector mounted on the other panel of said pair of opposed panels, said second deflector defining a portion of the first reduced opening, said second deflector having a second inlet plate forming a second inlet angle with the other panel of said pair of opposed panels being equal to or greater than 20° or being equal to or less than 80°, said second deflector having a second outlet plate connected to the second inlet plate, said second outlet plate forming a second outlet angle with the other panel of said pair of opposed panels being equal to or greater than 20° or being equal to or less than 80°.

6. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, and a first deflector mounted on one panel of said pair of opposed panels, said first deflector having a first inlet plate defining a portion of the first expansion chamber, and a first outlet plate connected to the first inlet plate, said first outlet plate connected to the one panel defining a portion of the second expansion chamber, said first inlet plate defining an inlet angle with the one panel, said first outlet plate defining an outlet angle with said one panel greater than the inlet angle.

7. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, the width of the shell is greater than two times the height of the shell and less than three times the height of the shell, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector defining a portion of the first expansion chamber, and a second deflector mounted on the other panel of the pair of opposed panels, said second deflector defining a portion of the first reduced opening.

8. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector having a first inlet plate defining a portion of the first expansion chamber, said inlet plate forming an angle with the one panel being equal to or greater than 20° or being equal to or less than 80°, said first deflector having a first outlet plate connected to the first inlet plate defining a portion of a second expansion chamber, said first outlet plate forming an angle with said one panel being equal to or greater than 20° or being equal to or less than 80°, and a second deflector mounted on the other panel of said opposed panels, said second deflector having a second inlet plate defining a portion of a second expansion chamber, said second inlet plate forming an angle with said other panel being equal to or greater than 20° or being equal to or less than 80°.

9. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector having a first inlet plate defining a portion of the first expansion chamber, said first deflector having a first outlet plate connected to the first inlet plate defining a portion of a second expansion chamber, said first inlet plate defining a first inlet angle with said one panel, said first outlet plate defining a first outlet angle with said one panel greater than the first inlet angle, and a second deflector mounted on the other panel of said pair of opposed panels, said second deflector having a second inlet plate defining a portion of the second expansion chamber, said second deflector having a second outlet plate connected to the second inlet plate, said second inlet plate defining a second inlet angle with said other panel, said second outlet plate defining a second outlet angle with said other panel greater than the second inlet angle.

10. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector defining a portion of the first expansion chamber, and a second deflector mounted on the other panel of said pair of opposed panels, said second deflector defining a portion of the first reduced opening, the minimum distance from each deflector to the panel opposite to the panel upon which the respective deflector is mounted being less than one half of the distance between the opposed panels, said shell having a width greater than two times the height of the shell and less than three times the height of the shell.

11. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector having a first inlet plate defining a portion of the first expansion chamber, said first deflector having a first outlet plate connected to the first inlet plate defining a portion of a second expansion chamber, said first outlet plate having a plurality of apertures for receiving exhaust gases, said first inlet plate defining an inlet angle with said one panel, said first outlet plate defining an outlet angle with said one panel, said outlet angle being greater than the inlet angle.

12. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of said opposed panels, said first deflector having an inlet plate defining a portion of the first expansion chamber, said first inlet plate forming a first inlet angle with said one panel being equal to or greater than 20° or being equal to or less than 80°, said first deflector having a first outlet plate connected to the inlet plate defining a portion of the second expansion chamber, said first outlet plate forming a first outlet angle with the one panel, the first outlet angle being greater than the first inlet angle, and a second deflector mounted on the other panel of said pair of opposed panels, said second deflector having a second inlet plate forming a second inlet angle with the other panel being equal to or greater than 20° or being equal to or less than 80°.

13. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector having a first inlet plate defining a portion of the first expansion chamber, said first deflector having a first outlet plate connected to the inlet plate defining a portion of the second expansion chamber, and said first outlet plate having a plurality of apertures for receiving exhaust gases, each of said apertures being an extruded aperture.

14. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a deflector mounted on one panel of said pair of opposed panels, said deflector having an inlet plate defining a portion of an expansion chamber, said deflector having an outlet plate connected to the one panel, said outlet plate defining a portion of second expansion chamber, said outlet plate having an aperture, and a Helmholtz tube mounted in the aperture in the outlet plate extending away from the second expansion chamber.

15. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, the width of said is greater than two times the height of the shell and less than three times the height of the shell, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a deflector mounted on one panel of said pair of opposed panels, said deflector having an inlet plate defining a portion of an expansion chamber, and an outlet plate connected to the inlet plate and to the one panel defining a portion of the second expansion chamber, said inlet plate defining an inlet angle with the one panel, said first outlet plate defining an outlet angle with said one panel greater than the inlet angle, said outlet plate having a plurality of apertures for receiving exhaust gases.

16. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of opposed panels, said first deflector having an inlet plate defining a portion of the first expansion chamber, and a first outlet plate connected to the first inlet plate and to the one panel defining a portion of the second expansion chamber, said first inlet plate defining an inlet angle with the one panel, and said first outlet plate defining an outlet angle with said one panel greater than the inlet angle, said first inlet plate having a plurality of apertures for receiving exhaust gases, and a second deflector mounted on the other panel of said pair of opposed panels, the minimum distance from each deflector to the panel opposite to the panel upon which the respective deflector is mounted being less than one half the distance between the opposed panels.

17. A high performance muffler for modifying sound waves of internal combustion engine exhaust gases comprising; an inlet adapted for connection to an internal combustion engine exhaust system for receiving internal combustion engine exhaust gases, a muffler body connected to the inlet for receiving internal combustion engine exhaust gases, said muffler body having a shell, said shell having a width greater than its height, the width of the shell is greater than two times the height of the shell and less than three times the height of the shell, said shell having a pair of spaced apart opposed panels, a flow path of exhaust gases through the muffler body, an outlet connected to the muffler body to receive exhaust gases from the muffler body, a first expansion chamber in the muffler body adjacent to the inlet to receive exhaust gases from the inlet to allow the exhaust gases to expand, said first expansion chamber extending across the width of the muffler body, a first reduced opening in the muffler body communicating with the first expansion chamber to receive exhaust gases from the first expansion chamber, said first reduced opening extending across the width of the muffler body, a second expansion chamber in the muffler body adjacent to the first reduced opening to receive exhaust gases from the first reduced opening, said second expansion chamber extending across the width of the muffler body, a second reduced opening in the muffler body communicating with the second expansion chamber to receive exhaust gases from the second expansion chamber, said second reduced opening extending across the width of the muffler body, said second reduced opening and the first reduced opening cooperating to direct the flow of exhaust gases thought the muffler body in a sinuous flow path, a third expansion chamber in the muffler body adjacent to the second reduced opening to receive exhaust gases from the second reduced opening, said third expansion chamber extending across the width of the muffler body and communicating with the outlet to allow the exhaust gases to leave the muffler body, whereby the volume of the sound of the exhaust gases passing through the muffler body is decreased by the conversion of part of the sound energy to heat energy and the frequency of the sound of the exhaust gases is modified in the muffler body, a first deflector mounted on one panel of said pair of said opposed panels, said first deflector having a first inlet plate defining a portion of the first expansion chamber, a first outlet plate connected to the first inlet plate and to the one panel defining a portion of the second expansion chamber, said first inlet plate defining an inlet angle with the one panel, said first outlet plate defining an outlet angle with said one panel greater than the inlet angle, said first outlet panel having a plurality of apertures for receiving exhaust gases, and a second deflector mounted on the other panel of said pair of opposed panels, said second deflector having a second inlet plate partially defining the first reduced opening, said second deflector including a second outlet plate connected to the second inlet plate, said second outlet plate defining a portion of the third expansion chamber, the minimum distance from each deflector to the panel opposite to the panel upon which the respective deflector is mounted being less than one half the distance between the opposed panels.

* * * * *